US006195964B1

(12) United States Patent
Kitao

(10) Patent No.: US 6,195,964 B1
(45) **Date of Patent: *Mar. 6, 2001**

(54) RECTANGULAR INNER BAG FOR LOADING INTO CYLINDRICAL CONTAINER

(75) Inventor: Kouji Kitao, Osaka (JP)

(73) Assignee: Sunstar Engineering Inc., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/945,500

(22) PCT Filed: Apr. 24, 1996

(86) PCT No.: PCT/JP96/01115

§ 371 Date: Oct. 24, 1997

§ 102(e) Date: Oct. 24, 1997

(87) PCT Pub. No.: WO96/33920

PCT Pub. Date: Oct. 31, 1996

(30) Foreign Application Priority Data

Apr. 25, 1995 (JP) ..... 7-099271

(51) Int. Cl.[7] ..... B65B 11/58

(52) U.S. Cl. ..... 53/449; 141/10; 141/114; 141/251; 141/313; 383/906

(58) Field of Search ..... 383/121, 107, 383/113, 104, 105, 111, 119, 120, 906; 220/495.06, 495.07, 495.08, 495.11; 141/10, 114, 251, 258, 260, 263, 284, 313, 314, 316, 319

(56) References Cited

U.S. PATENT DOCUMENTS

| | | | | |
|---|---|---|---|---|
| 1,916,493 | * | 7/1933 | Solomon | 383/113 |
| 2,092,969 | * | 9/1937 | Gustafson et al. | 220/495.11 X |
| 2,432,122 | * | 12/1947 | Pardee | 383/121 X |
| 2,673,024 | * | 3/1954 | Kuss | 383/121 |
| 3,001,207 | * | 9/1961 | Nail | 383/121 X |
| 3,119,548 | * | 1/1964 | Cook et al. | 383/121 |
| 3,837,375 | * | 9/1974 | Higgins et al. | 141/1 |
| 4,489,768 | * | 12/1984 | Scoles | 141/71 |
| 5,143,242 | * | 9/1992 | Millasich | 220/404 |
| 5,213,141 | * | 5/1993 | Dorman | 141/10 |
| 5,651,460 | * | 7/1997 | Foerderer | 206/447 |

* cited by examiner

*Primary Examiner*—Peter Vo
*Assistant Examiner*—Hemant M. Desai
(74) *Attorney, Agent, or Firm*—Sughrue, Mion, Zinn, Macpeak & Seas, PLLC

(57) ABSTRACT

An inexpensive inner bag loaded into a cylindrical container such as a drum. The inner bag has excellent airtightness and facilitates transferring the inner bag to a separate container. The inner bag comprises two hexagonal first sheets and two pentagonal second sheets. Each first sheet has a pair of opposite sides extending longitudinally and a trapezoidal portion formed around one longitudinal end of the sheet. Each second sheet has a pair of opposite sides extending longitudinally and a triangular portion formed around one longitudinal end of the sheet. The first and second sheets are placed in an opposite relation to each other. The peripheries of the first and second sheets, excluding the other ends, are bonded together by heat-sealing.

3 Claims, 6 Drawing Sheets

1(50)
23
27
31
21

11
27
12
1(50)
23
21

1(50)
27
23
12
11
24
1(50)
12
11

27
24
26
12
1(50)

33
27
1(50)
12
31
24

RECTANGULAR INNER BAG FOR LOADING INTO CYLINDRICAL CONTAINER

TECHNICAL FIELD

The present invention relates to an inner bag for loading into a cylindrical container and, more particularly, relates to an inner bag which is utilized to fill a moisture-curing resin or another material when the moisture-curing resin or the another material is filled into a cylindrical container such as a drum.

BACKGROUND ART

When viscous materials such as adhesive, sealant, or paint are filled into a cylindrical container such as a drum, it is common practice to fill the viscous materials into an inner bag after loading the inner bag into the drum so as to prevent the viscous materials from adhering to the inner surface of the drum; otherwise the drum would not be reusable.

FIG. 5 shows the structure of the conventional inner bag used for this purpose. This inner bag, indicated by reference numeral 50, generally comprises a cylindrical portion 54 and a circular sheet 56 forming the bottom of the inner bag 50. The cylindrical portion 54 consists of two rectangular sheets 52 which are bonded together at two side edges, indicated by 53, by heat-seal techniques. The circular sheet 56 is further bonded to the cylindrical portion 54 at the periphery 58 of the bottom also by heat-seal techniques.

The manner in which the viscous materials are filled into and discharged from the inner bag 50 as described above is illustrated in FIGS. 6(*a*)–6(*e*). FIGS. 6(*a*)–6(*e*) show that a sequence of steps begins with installing of the inner bag 50 in the cylindrical drum and ends with discharging the viscous materials from the inner bag. This sequence of steps is hereinafter described briefly. A pump for filling under pressure the viscous materials toward the bottom of the drum, indicated by 23, has a follower plate 31. The inner bag 50 is installed at its one end on the follower plate 31. Under this condition, the viscous materials, indicated by 27, are filled into the inner bag 50, as shown in FIG. 6(*a*). Then, the other end 11 of the inner bag 50 is closed to form a closed portion 12, as shown in FIG. 6(*b*). The drum 23 is inverted so as to overlap a separate drum 24, and the inner bag 50 of the drum 23 is transferred into the separate drum 24 in such a manner that the closed portion 12 of the other end 11 of the inner bag 50 is brought into contact with the bottom of the separate drum 24, as shown in FIG. 6(*c*). Subsequently, the drum 24 is closed with a top cover 26, as shown in FIG. 6(*d*). When the viscous materials 27 are discharged at a consumer's site, the top cover 26 is removed and then the bottom 21 of the inner bag 50 is cut with a cutter knife or the like to form an opening. The viscous materials 27 are discharged through a central opening 33 of the follower plate 31 of the pump, as shown in FIG. 6(*e*).

A reason why the viscous materials 27 are filled into and discharged from the inner bag by the method described above is follows. In the case where the viscous materials 27 are a moisture-curing resin, air remaining in the closed portion of the other end 11 of the inner bag 50 and moisture in the air serve to cure surface portions of the viscous materials 27 which are located in adjacent to the closed portion. Therefore, the inner bag 50 of the drum 23 is transferred to the separate drum 24 in the inversion manner, that is, is turned upside down. Accordingly, the uncured portion of the materials which are in the bottom of the inner bag 50 of the drum 23 can be discharged firstly.

In addition, in the case where the conventional cylindrical inner bag 50 as described above is utilized, following problems are occurred. As shown in FIG. 5, the inner bag 50 is fabricated by bonding the cylindrical portion 54 to the circular sheet 56 forming the bottom at the periphery 58 of the bottom by heat-seal techniques. The cylindrical portion 54 is obtained by bonding together the two rectangular sheets 52 at two side edges by heat-seal techniques. Therefore, it is difficult to subject the circular sheet 56 to a heat-seal operation. Sometimes, some portions of the sheet do not sufficiently undergo the heat-seal operation. In this case, when the inner bag is kept in stock or being delivered to consumer's site, air containing moisture enters the inner bag 50, as a result of which there is a possibility that the moisture-curing resin on the bottom 21 as well as the resin in the closed portion 12 is cured. Furthermore, the heat-seal operation is difficult to carry out. This results in an increase in the cost.

When the cylindrical inner bag 50 accommodating the viscous materials 27 and loaded on the cylindrical container such as a drum is transferred into other drum, if one tries to invert the loaded drum in order to transfer the inner bag 50, any gap is not easily formed between the outer periphery of the inner bag and the inner wall of the drum, due to the fact that the inner bag 50 has a cylindrical contour which is substantially coincided with that of the drum. Therefore, the bottom portion of the loaded drum is placed in a vacuum condition. Hence, the inner bag 50 is not easily dropped off from the inverted drum. In this way, it is difficult to transfer the inner bag.

With this conventional art inner bag 50, the permeability of air deteriorates the quality of the viscous materials 27. The cost is increased because it is difficult to perform the heat-seal operation. Furthermore, the transfer operation is not carried out efficiently. These are problems in the conventional technique.

DISCLOSURE OF THE INVENTION

It is an object of the present invention to provide an inner bag which is free of the foregoing problems with the conventional techniques, is adapted for loading into a cylindrical container, has excellent airtight characteristics, is economical to fabricate, and facilitates transferring the same between the cylindrical containers.

An inner bag according to the present invention comprises two hexagonal first sheets and two pentagonal second sheets. Each first sheet has a pair of opposite sides extending longitudinally and a trapezoidal portion around one longitudinal end of the sheet. Each second sheet has a pair of opposite sides extending longitudinally and a triangular portion around one longitudinal end of the sheet. The first and second sheets are placed in an opposite relation to each other when the inner bag is in an unfolded condition. The peripheries of the first and second sheets, excluding the other ends, are bonded together by heat-sealing.

In the aspect of the invention, each of the first and second sheets may be a laminate sheet using aluminum.

The inner bag, according to the present invention, adapted to be loaded into a cylindrical container is fabricated in the manner described now. The top sides of the trapezoidal portions around the longitudinal ends of the two first sheets are bonded together by heat-sealing; one of the two non-parallel sides of the trapezoidal portion of each of the two first sheets and one of the two sides of the triangular portion of one of the second sheets are bonded together by heat-sealing; and the other one of the two non-parallel sides of the trapezoidal portion of each of the two first sheets and the other one of the two sides of the triangular portion of one of the second sheets are bonded together by heat-sealing, in such a manner that the bottom of the inner bag is defined by the trapezoidal and triangular portions. Further, the pair of opposite sides of the first sheets are respectively bonded with the pair of opposite sides of the second sheets. However, no heat-sealing is applied to the sides opposite to the trapezoidal and triangular portions and thus an opening is at this location. Thereby, the inner bag in the form of a baglike-shaped container having a closed bottom and an opened top can be easily constituted by applying the heat-sealing to straight or planar portions of the first and second sheets.

In the case where the angle made by the two sides not parallel to the base of the trapezoidal portion of each first sheet is set to about 45°, and the basic angles of the second sheets are set to about 45° so that the triangular portion becomes an isosceles triangle, under the unfolded condition of the inner bag, the surface can be defined by a horizontal, substantially square or rectangular form having little unevenness.

In addition, in the case where each of the first and second sheets is a laminate sheet using aluminum, the waterproofness can be enhanced.

BRIEF DESCRIPTION OF THE DRAWINGS

FIG. 2(*b*) is a plan view of the second sheet;

FIG. 3(*b*) is a perspective view of the inner bag according to the present invention in which the bottom assumes a horizontal, substantially square form;

BEST MODE FOR CARRYING OUT THE INVENTION

Figure 1:
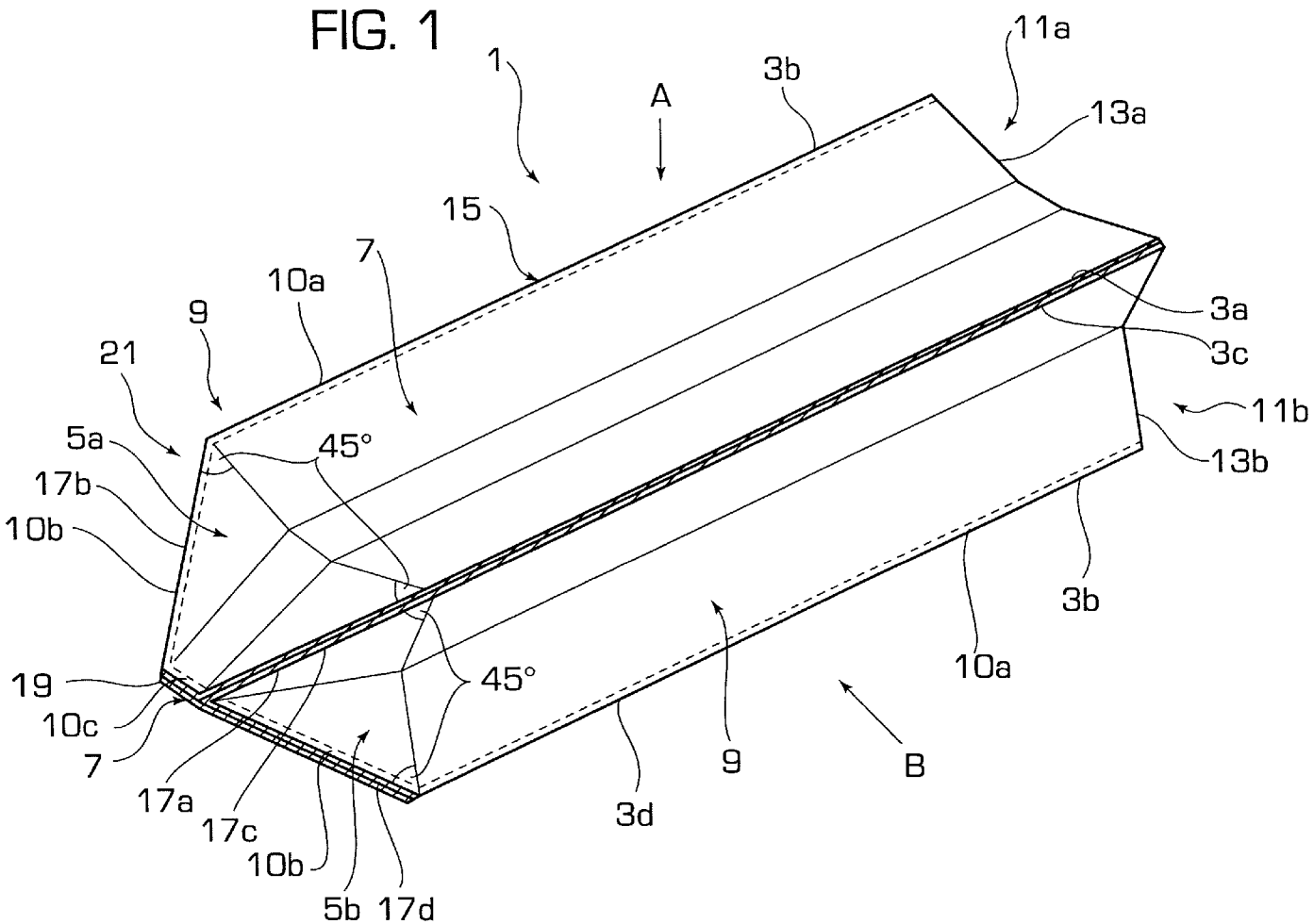
FIG. 1 is a perspective view of an inner bag for loading into a cylindrical container, the inner bag being fabricated according to the present invention.
Figure 2A:
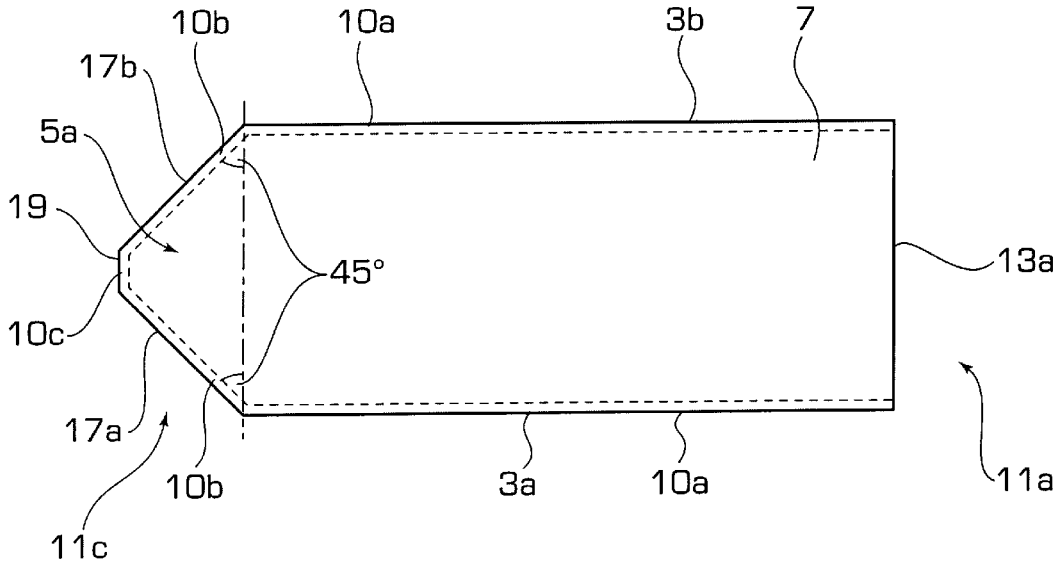
FIG. 2(*a*) is a plan view of the first sheet.
Figure 2B:
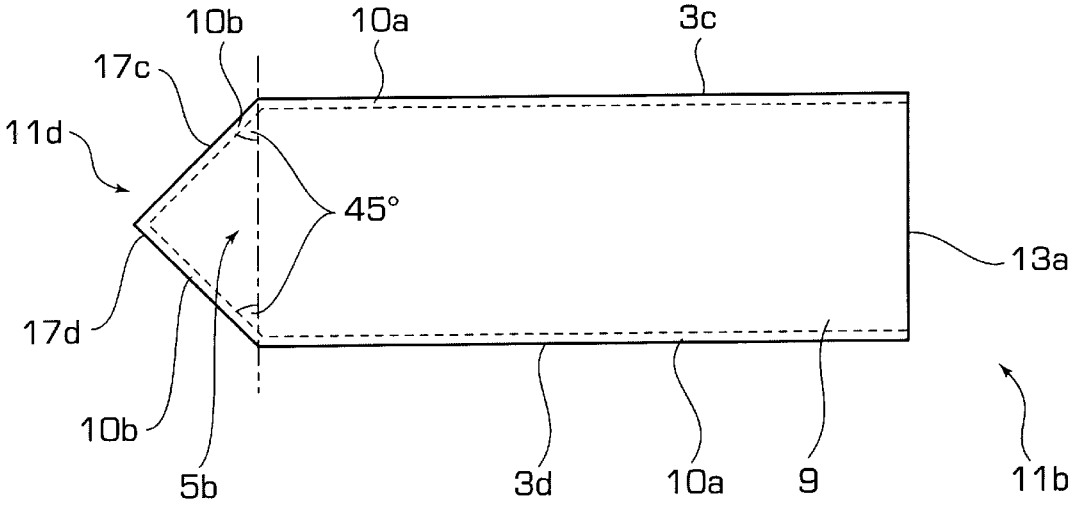

Referring to FIGS. 1, 2(*a*), and 2(*b*), there is shown an inner bag embodying the concept of the invention, the inner bag being adapted for loading into a cylindrical container. The inner bag, generally indicated by reference numeral 1, comprises two hexagonal first sheets 7 and two pentagonal second sheets 9. Each first sheet 7 has a pair of opposite sides 3*a*, 3*b* extending longitudinally and a trapezoidal portion 5*a* formed around one longitudinal end 11*c* of the sheet 7. Each second sheet 9 has a pair of opposite sides 3*c*, 3*d* extending longitudinally and a triangular portion 5*b* formed around one longitudinal end 11*d* of the sheet 9. The first sheets 7 and the second sheets 9 are placed in an opposite relation to each other when the inner bag 1 is in an unfolded condition. The peripheries of these sheets 7 and 9, excluding their respective other sides 13*a* and 13*b* which are located at the other longitudinal ends 11*a* and 11*b*, are bonded together by the heat-seal techniques, in such a manner that the inner bag 1 in the form of a rectangular-shaped container having a closed bottom and a opened top is constituted by the first and second sheets.

In each of the aforementioned first sheets 7, the opposite sides 3*a* and 3*b* extend parallel to each other longitudinally. Each first sheet 7 has the trapezoidal portion 5*a* around its one end. In this trapezoid, the two sides not parallel to the base make an angle of about 45°. In each of the second sheets 9, the opposite sides 3*c* and 3*d* extend parallel to each other longitudinally. Unlike the first sheets 7, each second sheet 9 has the triangular portion 5*b* around its one end. This triangular portion 5*b* is an isosceles triangle whose basic angles (interior angles) are about 45°.

Figure 3A:
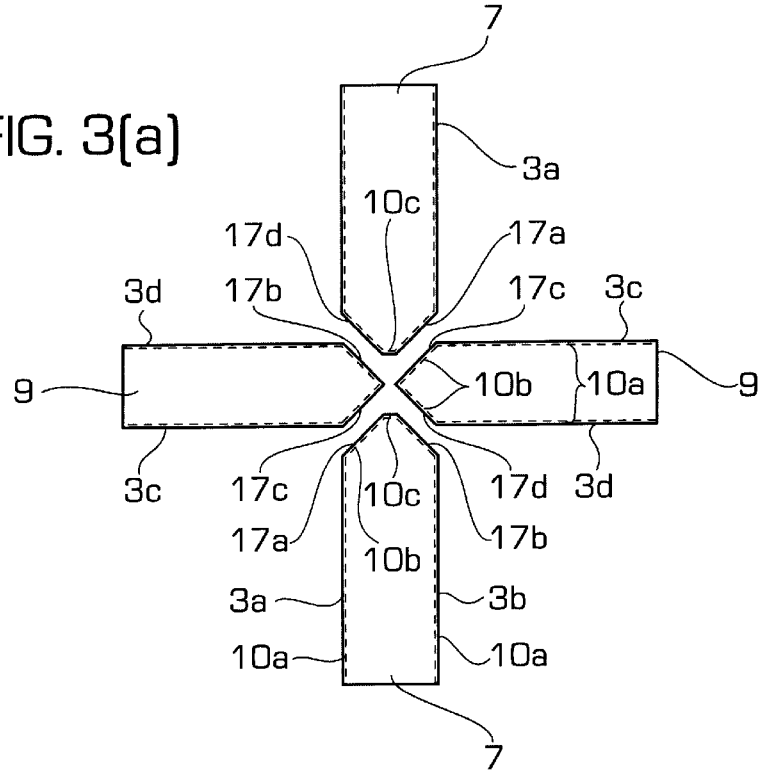
FIG. 3(*a*) is an evolution view of the inner bag to be formed by the first sheet and the second sheet.
Figure 3B:
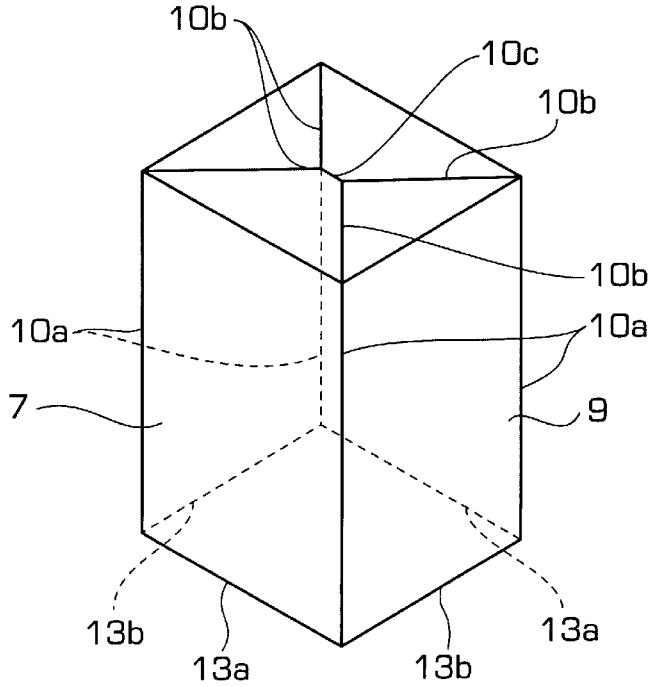

As shown in FIG. 3(*a*), the sides 3*a* of the first sheets 7 and the sides 3*c* of the second sheets 9 are respectively bonded together by heat-sealing. Similarly, the sides 3*b* of the first sheets 7 and the sides 3*d* of the second sheets 9 are respectively bonded together by heat-sealing. Thus, the trunk 15 of the inner bag 1 for loading into the cylindrical container is constituted by heat-seal bonded portions 10*a* which formed by the sides 3*a*–*e*. Further, as shown in FIG. 3(*a*), the two non-parallel sides 17*a* and 17*b* of the trapezoidal portion of each first sheet 7 are respectively bonded to the two sides 17*c* and 17*d* of the triangular portion of each second sheet 9 by heat-sealing, thus forming a heat-seal bonded portion 10*b*. The top sides 19 of the trapezoidal portions of the first sheets 7 are bonded together by heat-sealing, thus forming another heat-seal bonded portion 10*c*. In this manner, the bottom 21 of the inner bag 1 is constituted. FIG. 3(*b*) shows a perspective view of the inner bag 1 thus constituted by heat-sealing of two first sheets 7 and two second sheets 9.

The first sheets each having the trapezoidal portion at its front end and the second sheets each having the triangular portion at its front end are made to be bonded each other by heat-sealing at an angle of about 45°. When the inner bag is unfolded, the bottom surface assumes a horizontal, substantially square form.

Figure 7:
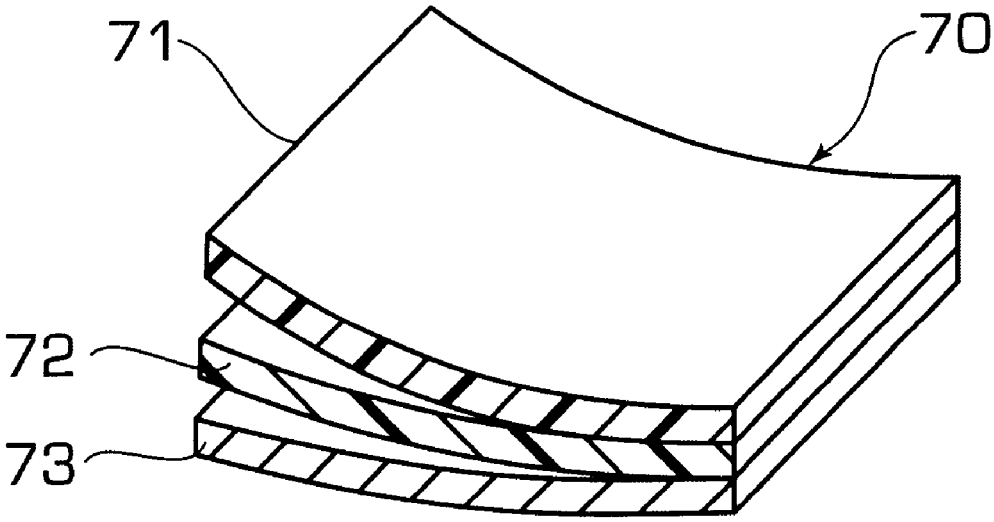
FIG. 7 shows a laminate sheet using aluminum.

In order to prevent the permeation of air, these first and second sheets are preferably made of a laminate sheet of aluminum having a high rigidity and a high airtightness. This laminate sheet comprises a sheet 70 of a thermoplastic synthetic resin 71 and 73 such as nylon, polyester, polyethylene, polypropylene, or ethylene copolymer capable of heat-sealing, and aluminum foil 72 on which the thermoplastic resinous sheet is laminated as shown in FIG. 7, due to the fact that the aluminum foil can secure high airtightness and the thermoplastic resinous sheet permits heat-seal.

An example of usage of the inner bag 1 for loading into the cylindrical container is hereinafter described. The manner in which the viscous materials are filled in and discharged from the inner bag when the inner bag 1 is used is similar to the method already described in conjunction with FIGS. 6(*a*)–(*e*) and will be described in further detail by referring again to FIGS. 6(*a*)–6(*b*).

Figures 6A, 6B, 6C, 6D, 6E:
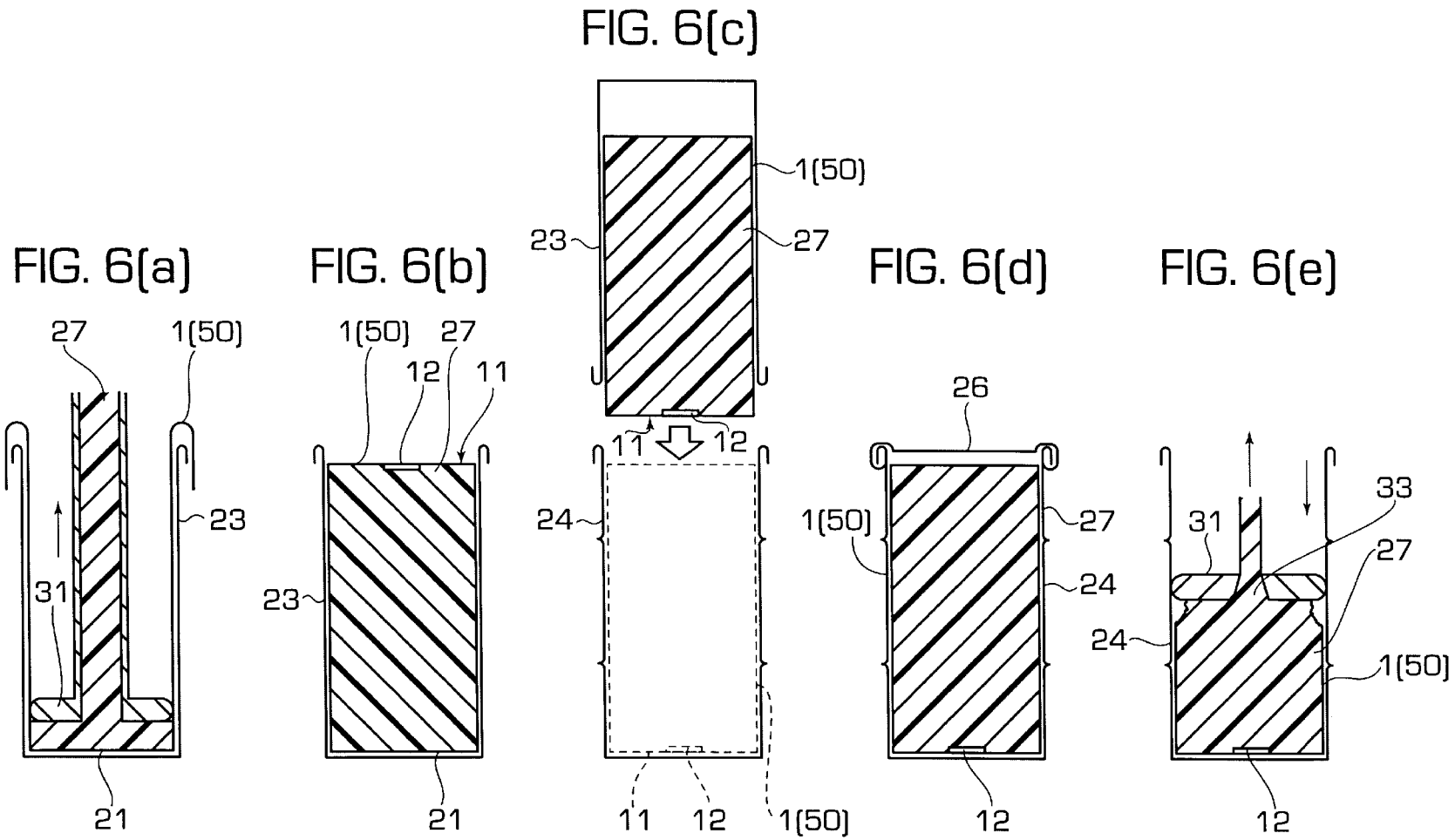
FIGS. 6(*a*)–6(*e*) are a series of cross sections of the inner bag shown in FIG. 1, illustrating the manner in which viscous materials are filled into and discharged from the inner bag.

The drum 23 is prepared. The novel inner bag 1 for loading into the cylindrical container is loaded into the drum 23, together with the follower plate 31 of the pump. Then, the viscous materials 27 are received in this inner bag 1, as shown in FIGS. 6(*a*) and 6(*b*). On loading of the inner bag 1, the bottom 21 of the inner bag has little unevenness and takes a horizontal, substantially square form. Therefore, the inner bag can be placed onto the bottom of the drum 23 in such a way that the bottom 21 is substantially horizontal.

Consequently, when the viscous materials 27 are filled into the inner bag 1, the follower plate 31 in a horizontal posture can be brought into contact with the bottom 21 of the inner bag 1 that is placed horizontal. Hence, the permeation of air can be suppressed.

Then, the drum 23 is inverted and placed on the separate drum 24 so as to overlap it. The inner bag 1 is transferred in such a manner that the closed portion 12 of the other end 11 of the inner bag 1 is brought in contact with the bottom of the drum 24, as shown in FIG. 6(*c*). Subsequently, the drum 24 is closed with the top cover 26, as shown in FIG. 6(*d*).

Figure 4:
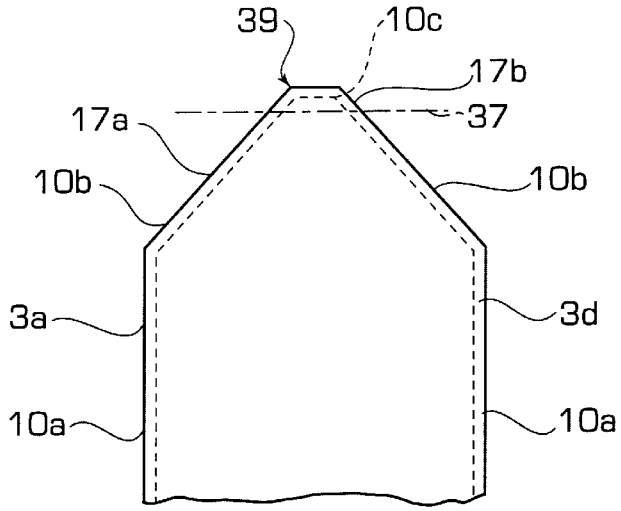
FIG. 4 is a fragmentary plan view of the inner bag shown in FIG. 1, illustrating one example of discharging port formed in the bag shown in FIG. 1.
Figure 5:
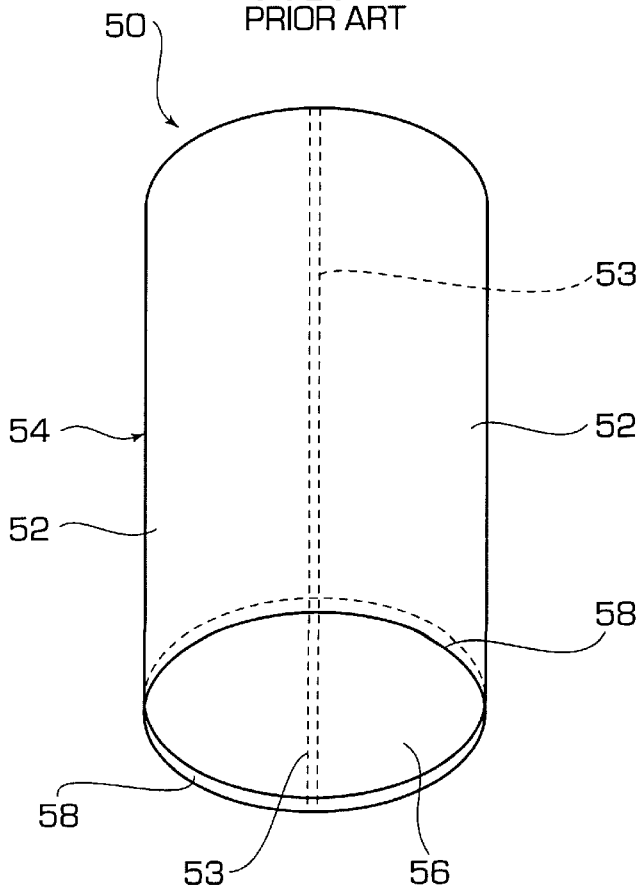
FIG. 5 PRIOR ART
FIG. 5 is a perspective view of the conventional inner bag.

When the viscous materials 27 are to be discharged at a consumer's site, the top cover 26 is removed and then the bottom 21 of the inner bag 1 is cut with a cutter knife or the like to form an opening in the center of the bottom. The viscous materials 27 are discharged through the central opening 33 in the follower plate 31 of the pump, as shown in FIG. 6(*e*). When the opening is formed at the bottom 21 of the inner bag 1, the heat-seal bonded central portion 39 is cut out along an appropriate cutting line 37 as shown in FIG. 4 to form a circular hole. The viscous materials 27 are discharged through this hole.

Since the novel inner bag 1 is consisted of the four sheets 7 and 9, when the inner bag 1 loaded in a cylindrical container such as a drum is transferred into a separate drum while the viscous materials 27 are held in the inner bag 1 and the inner bag is transferred after inverting the drum, a gap is readily formed between the inner bag and the inner wall of the drum. Because portions around the bottom are not in a vacuum condition when the inner bag is transferred between the drum, the inner bag can be easily and smoothly transferred.

On the other hand, in the case where the inner bag 1 is consisted of the four sheets 7 and 9 each having a low rigidity, there is a possibility that the any gay is not readily formed between the inner bag and the inner wall of the drum while the inner bag 1 loaded in the drum is transferred into a separate drum. In this case, it is preferable to provide at the bottom or the peripheral wall of the drum an opening or valve through which air can be supplied into the interior of the drum so as to aid the transferring operation of the inner bag. At this time, air is inputted into the portions around the bottom, so that the inner bag can be easily and smoothly transferred.

INDUSTRIAL APPLICABILITY

In accordance with the present invention following great advantages can be obtained. An inner bag according to the present invention, which is adapted to be loaded in a cylindrical container, comprises two first sheets and two second sheets, wherein each first sheet has a trapezoidal portion around its one end; the top sides of the trapezoidal portions of the two first sheets are bonded together by heat-sealing; each second sheet has a triangular portion around its one end; one of the two nonparallel sides of each second sheet and the two sides of the triangular portion of one of the second sheets are respectively bonded together by heat-sealing. Thus, a baglike form whose bottom is formed by the trapezoidal and triangular portions of the first and second sheets is obtained.

In the case where the angle made by the two sides not parallel to the base of the trapezoidal portion of each first sheet is set to about 45°, and the basic angles (interior angles) of the second sheets are set to about 45° so that an isosceles triangle is formed around one end of each first sheet, then the bottom takes a square form.

Therefore, the straight, planar portions are subjected to the heat-seal. Unlike the conventional inner bag having a cylindrical bottom, the heat-sealing can be easily and certainly done. This can prevent the quality of the contents from deteriorating. Furthermore, the easiness of heat-seal operation leads to a reduction in the cost. Moreover, the inner bag can be adapted onto the bottom of a drum, because the bottom of the inner bag assumes a horizontal, substantially square form. The inner bag can be filled with the viscous materials. In addition, the amount of remaining air can be minimized.

Since the inner bag according to the present invention is made up of the four sheets, when the inner bag loaded in a cylindrical container such as a drum and holding contents therein is transferred into a separate drum, the former drum is inverted to permit the inner bag to be transferred. At this time, a gap is easily formed between the inner bag and the inner wall of the drum. This prevents portions around the bottom from being placed in a vacuum condition. Hence, the inner bag can be easily transferred. This also improves the efficiency of the work.

After the contents are used, if only the inner bag is discarded, then the outer container, or the drum, is capable of being reused like a new container. This can reduce the amount of industrial wastes. Saving of resources can be accomplished. In this way, the invention yields conspicuous advantages.

While the present invention has been described above with respect to two preferred embodiments thereof, it should of course be understood that the present invention should not be limited only to these embodiments but various change or modification may be made without departure from the scope of the present invention as defined by the appended claims.

What is claimed is:

1. A container assembly comprising:

a first cylindrical container;

a rectangular inner bag for receiving a highly viscous material and thereafter tightly closing to hold said highly viscous material, said rectangular inner bag including (1) two hexagonal first sheets each of which has a pair of opposite sides extending longitudinally and a trapezoidal portion formed around one longitudinal end of said first sheet; and (2) two pentagonal second sheets each of which has a pair of opposite sides extending longitudinally and a triangular portion formed around one longitudinal end of said second sheet, said first and said second sheets being placed in an opposite relation to each other, peripheries of said first and said second sheets excluding other ends being bonded together by heat-sealing, said rectangular inner bag being placed in said first cylindrical container so that a bottom of said rectangular inner bag is substantially horizontal with respect to said first cylindrical container;

an annular plate through which said highly viscous material passes and which is provided at the bottom of said rectangular inner bag;

a second cylindrical container overlapping said first cylindrical container, said first and said second cylindrical containers having respective interior volumes that are substantially equal, wherein said first cylindrical container and said second cylindrical container are invertible so as to transfer said rectangular inner bag from said first cylindrical container to said second cylindrical container.

2. A container product made by the process of:

providing a first cylindrical container;

placing a rectangular inner bag into said first cylindrical container such that a bottom of said rectangular inner bag is substantially horizontal, said rectangular inner bag including (1) two hexagonal first sheets each of which has a pair of opposite sides extending longitudinally and a trapezoidal portion formed around one longitudinal end of said first sheet; and (2) two pentagonal second sheets each of which has a pair of opposite sides extending longitudinally and a triangular portion formed around one longitudinal end of said second sheets, said first and said second sheets being placed in an opposite relation to each other, peripheries of said first and said second sheets excluding other ends being bonded together by heat-sealing;

placing a plate over the bottom of said rectangular inner bag in a substantially horizontal relation to the bottom of said rectangular inner bag;

receiving viscous materials into said rectangular inner bag through said plate;

sealing an opening portion of said rectangular inner bag;

placing a second cylindrical container overlapping said first cylindrical container, said first and said second cylindrical containers having respective interior volumes that are substantially equal;

inverting said first cylindrical container and said second cylindrical container; and transferring said rectangular inner bag to said second cylindrical container such that (1) said opening portion that is sealed during said sealing step is provided at a bottom of said second cylindrical container, and (2) the bottom of said rectangular inner bag is provided at a top of said second cylindrical container, wherein said rectangular inner bag is placed in said first cylindrical container such that a gap is formed between said rectangular inner bag and an inner wall of said first cylindrical container, whereby when said first cylindrical container is inverted said rectangular inner bag is easily removed.

3. A container product comprising:

a cylindrical container; and a rectangular inner bag including (1) two hexagonal first sheets each of which has a pair of opposite sides extending longitudinally and a trapezoidal portion formed around one longitudinal end of said first sheet; and (2) two pentagonal second sheets each of which has a pair of opposite sides extending longitudinally and a triangular portion formed around one longitudinal end of said second sheet, said first and said second sheets being placed in an opposite relation to each other, peripheries of said first and said second sheets excluding other ends being bonded together by heat-sealing, said other ends defining an opening through which a highly viscous material is introduced into said rectangular inner bag, said opening being sealed after said highly viscous material is introduced into said rectangular inner bag, wherein said rectangular inner bag is placed in said cylindrical container such that said sealed opening is provided at a bottom of said cylindrical container.

* * * * *